US006906298B2

(12) United States Patent
Han et al.

(10) Patent No.: US 6,906,298 B2
(45) Date of Patent: Jun. 14, 2005

(54) MAGNETRON DRIVING CIRCUIT BOARD FOR MICROWAVE OVEN

(75) Inventors: Dae-Sung Han, Hwasung (KR); Yong-Woon Han, Kunpo (KR); Young-Won Cho, Suwon (KR); Seong-Deog Jang, Suwon (KR); Joo-Yong Yeo, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 79 days.

(21) Appl. No.: 10/393,986

(22) Filed: Mar. 24, 2003

(65) Prior Publication Data

US 2004/0050842 A1 Mar. 18, 2004

(30) Foreign Application Priority Data

Sep. 14, 2002 (KR) ..... 2002-55990

(51) Int. Cl.[7] ..... H05B 6/66
(52) U.S. Cl. ..... 219/702; 219/756
(58) Field of Search ..... 219/702, 756, 219/761, 763, 757, 681, 400; 126/21 A

(56) References Cited

U.S. PATENT DOCUMENTS 5,874,714 A * 2/1999 Sik ..... 219/681
5,986,250 A * 11/1999 Kang et al. ..... 219/746
6,362,463 B1 * 3/2002 Bessyo et al. ..... 219/715
6,414,287 B2 7/2002 Han et al.

FOREIGN PATENT DOCUMENTS

JP 2002140996 A * 5/2002 ..... H01J/23/00

* cited by examiner

*Primary Examiner*—Quang T. Van
(74) *Attorney, Agent, or Firm*—Staas & Halsey LLP

(57) ABSTRACT

A microwave oven having a magnetron that generates microwaves, a magnetron driving circuit that supplies high voltage power to the magnetron and a machine room that accommodates the magnetron and the magnetron driving circuit. The microwave oven includes a single magnetron driving circuit board in which the magnetron and the electronic devices of the magnetron driving circuit are mounted thereon. The single magnetron driving circuit board is fixedly attached to the machine room by mounting members.

25 Claims, 8 Drawing Sheets

MAGNETRON DRIVING CIRCUIT BOARD FOR MICROWAVE OVEN

CROSS-REFERENCE TO RELATED APPLICATIONS

This application claims the benefit of Korean Application No. 2002-55990, filed on Sep. 14, 2002, in the Korean Intellectual Property Office, the disclosure of which is incorporated herein by reference.

BACKGROUND OF THE INVENTION

1. Field of the Invention

The present invention relates to microwave ovens, and more particularly, to a magnetron driving circuit board for a microwave oven, in which a magnetron and a magnetron driving circuit are mounted on a single board.

2. Description of the Related Art

In general, a circuit for driving a magnetron in a microwave oven comprises high voltage devices including a high voltage condenser, a high voltage diode, a high voltage transformer, etc. The magnetron driving circuit boosts a commercial alternating current AC voltage to a voltage of 2000 V using the high voltage transformer, boosts the voltage of 2000 V to a voltage of 4000 V required to drive the magnetron, and supplies the voltage of 4000 V to the magnetron.

FIG. 1 is a partially cutaway view showing a construction of a machine room of a conventional microwave oven. As depicted in FIG. 1, an oven body 120 is provided with a cooking cavity 121, and a machine room 122 in which a variety of electric and electronic devices are installed. A door 123 is attached to a front of the cooking cavity 121 to selectively open and close the cooking cavity 121, while a control panel 124 is attached to a front of the machine room 122 to control various operations of the conventional microwave oven. A circuit board 135 is positioned in back of the control panel 124 to control an entire operation of the microwave conventional oven in response to a manipulation of the control panel 124.

High voltage devices including a magnetron 130, a high voltage transformer 131, a high voltage condenser 182, a high voltage diode 184, etc., are installed in the machine room 122. The magnetron 130 receives high voltage power from the high voltage devices 131, 182 and 184, and generates microwaves to irradiate the cooking cavity 121. As a result, food is cooked in the cooking cavity 121 by the microwaves irradiated by the magnetron 130.

Other electric and electronic devices except for the above-described electric and electronic devices, which are required to implement various operations of the microwave oven, are disposed in the machine room 122. A blowing fan 132 is mounted on a back of the machine room 122 to suck outside air and cool the magnetron 130 with the sucked outside air. A noise filter 133 is installed at a position above the blowing fan 132 to eliminate high voltage noise. A power cord 134 is connected to the noise filter 133 to receive power from an outside power source (not shown).

Power and control signals are supplied to the various electric and electronic devices positioned in the machine room 122 through two bundles of wires 140 and 150. The two bundles of wires 140 and 150 are a first bundle of wires 140 and a second bundle of wires 150 that supply the power and control signals to electric and electronic devices positioned on a rear and front portions of the machine room 122, respectively. The first and second bundles of wires 140 and 150 are electrically connected to each other through two terminals 142 and 152.

FIG. 2 is a circuit diagram of the conventional microwave oven, which shows electrical connections between the magnetron 130, the high voltage transformer 131, the high voltage condenser 182, the high voltage diode 184, and the noise filter 133.

A construction of the machine room 122 of the conventional microwave oven is described below. The magnetron 130 and the high voltage devices 131, 182 and 184 are mounted on a wall and a bottom of the machine room 122, respectively. The first and second bundles of wires 140 and 150 are intertwined to connect the magnetron 130 and the high voltage devices 131, 182 and 184 to corresponding locations.

Due to a complicated configuration of the machine room of a conventional microwave oven, an assembly of the machine room requires excessive time in a process of manufacturing the conventional microwave oven. Further, the complicated configuration of the machine room causes utilization of the machine room to be deteriorated, which is a cause of increasing a size of an oven body.

SUMMARY OF THE INVENTION

Accordingly, an aspect of the present invention is to provide a microwave oven in which a magnetron and other high voltage devices are mounted on a single board to be packaged, so an assembly of a machine room is simplified, and utilization of the machine room is increased or a size of an oven body is reduced.

Additional aspects and advantages of the invention will be set forth in part in the description which follows and, in part, will be obvious from the description, or may be learned by practice of the invention.

The foregoing and/or other aspects are achieved by providing a microwave oven having a magnetron that generates microwaves, a magnetron driving circuit that supplies high voltage power to the magnetron and a machine room that accommodates the magnetron and the magnetron driving circuit, which includes a magnetron driving circuit board in which the magnetron and the electronic devices of the magnetron driving circuit are mounted on a single board, wherein the magnetron driving circuit board is fixedly attached to the machine room by mounting units.

BRIEF DESCRIPTION OF THE DRAWINGS

The above and other aspects and advantages of the present invention will become apparent and more appreciated from the following detailed description of the preferred embodiments, taken in conjunction with the accompanying drawings of which.

DETAILED DESCRIPTION OF THE PREFERRED EMBODIMENTS

Figure 1:
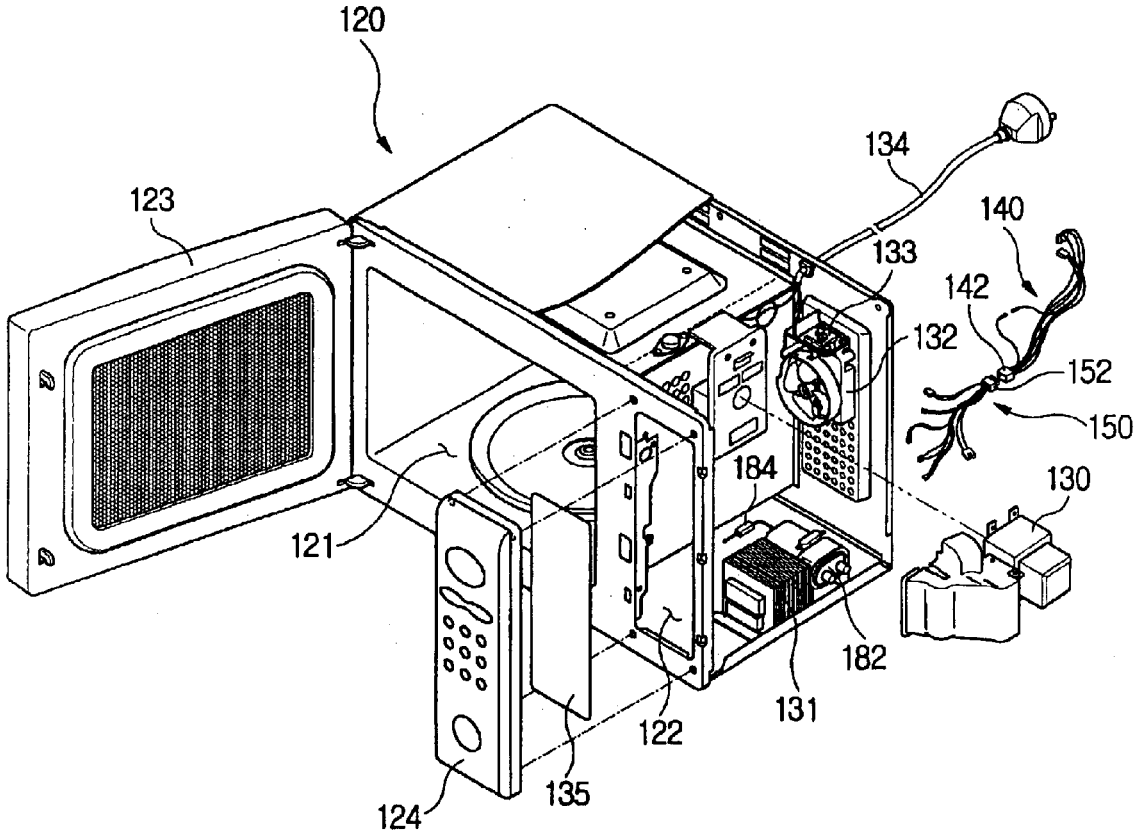
FIG. 1 (PRIOR ART)
FIG. 1 is a partially cutaway view showing a construction of a machine room of a conventional microwave oven.
Figure 2:
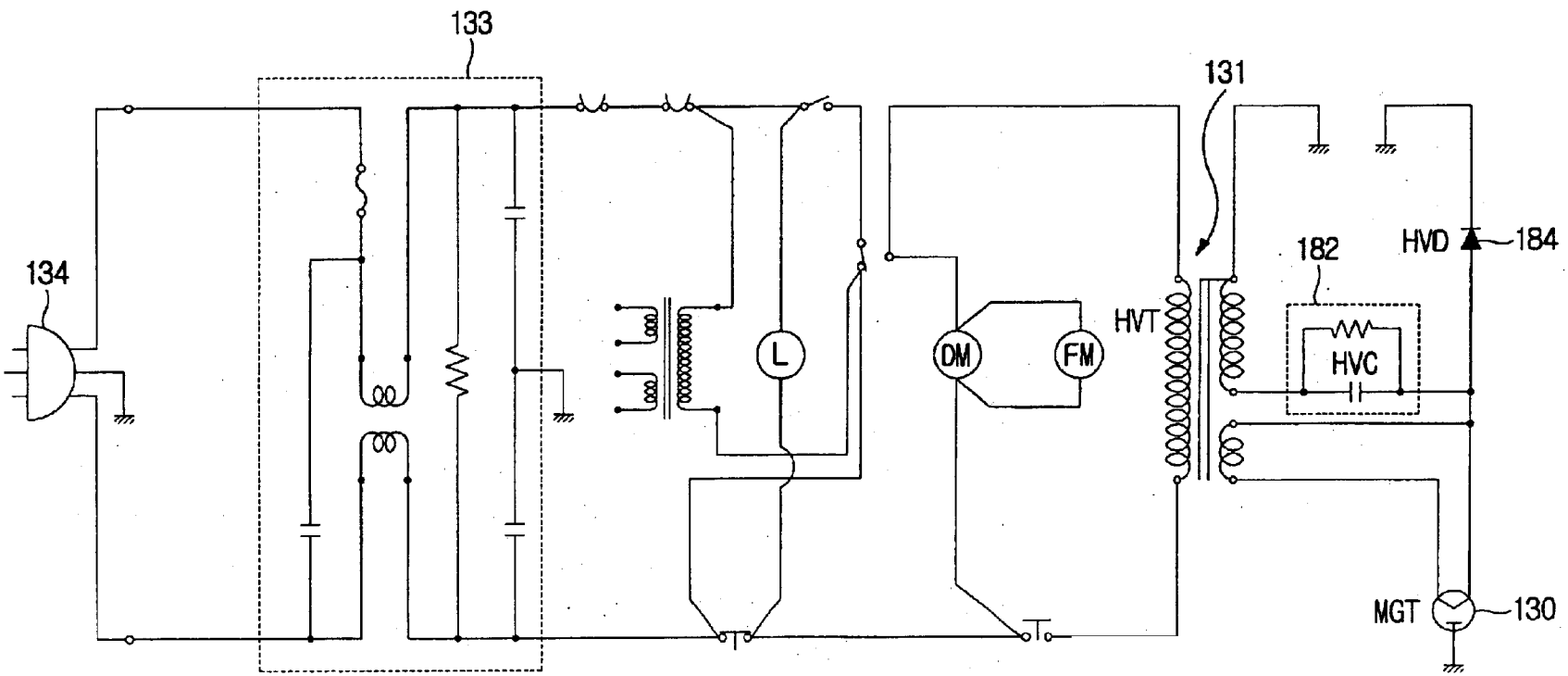
FIG. 2 (PRIOR ART)
FIG. 2 is a circuit diagram of the conventional microwave oven.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3A:
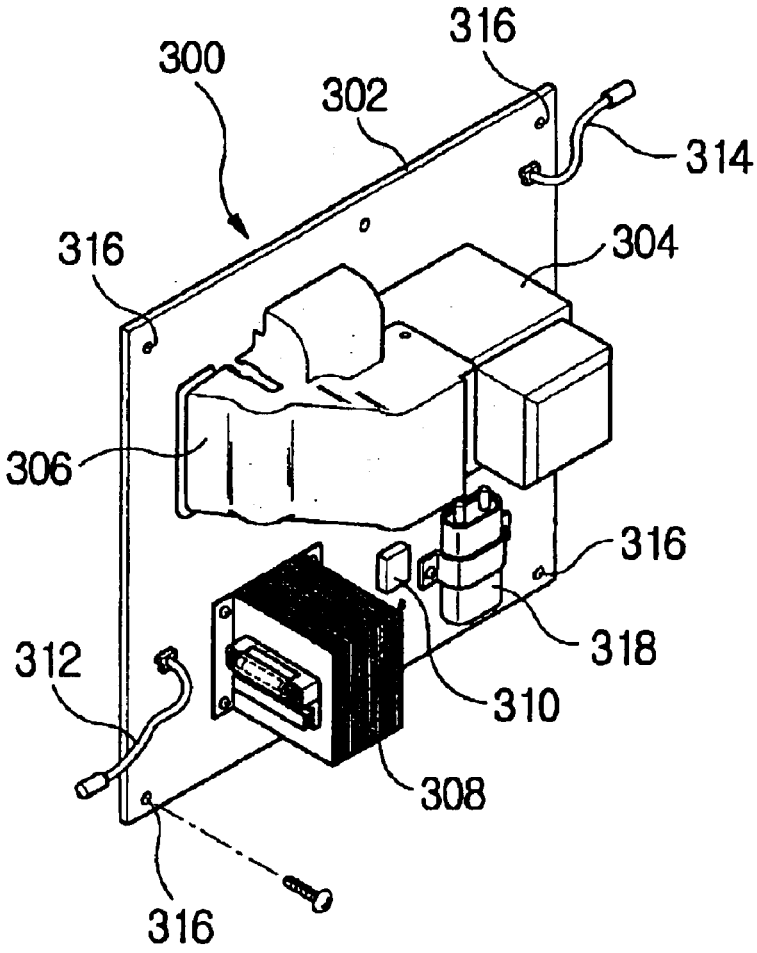
FIGS. 3A and 3B are views of a magnetron driving circuit board in accordance with a first embodiment of the present invention.
Figure 3B:
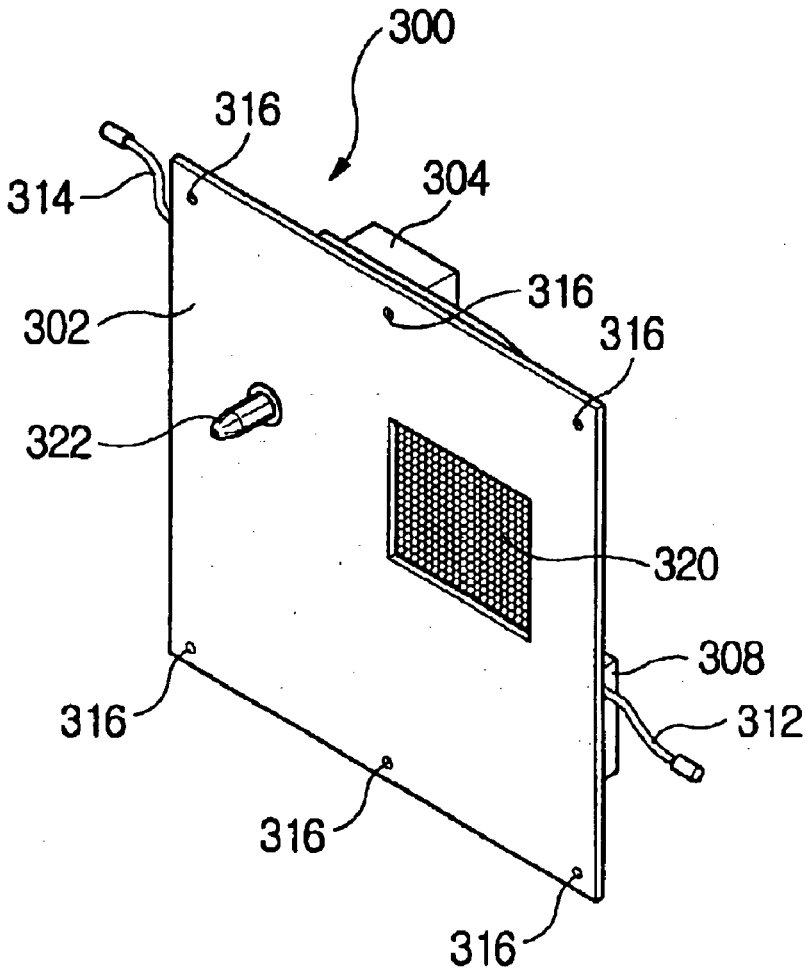

A microwave oven in accordance with a first embodiment of the present invention is described with reference to FIGS. 3A to 5. FIGS. 3A and 3B are views of a magnetron driving circuit board 300 in accordance with the first embodiment of the present invention. As depicted in FIG. 3A, a magnetron 304 and an air cover 306 are fixedly mounted on an upper portion of a circuit board 302. A high voltage condenser 318, a high voltage diode 310 and a high voltage transformer 308 are fixedly mounted on a lower portion of the circuit board 302 below the magnetron 304 and the air cover 306. The air cover 304 operates to supply air generated by a blowing fan (now shown) to an interior of a cooking cavity (not shown). The circuit board 302 is provided with a power cable 314 that supplies power and a control signal cable 312 that receives control signals from a control unit (not shown). The power cable 314 and the control signal cable 312 are, respectively, constructed in a form of a harness to be easily connected to a power terminal and control terminals, respectively. A plurality of mounting holes 316 is formed along edges of the circuit board 302 to receive mounting units.

Figure 5:
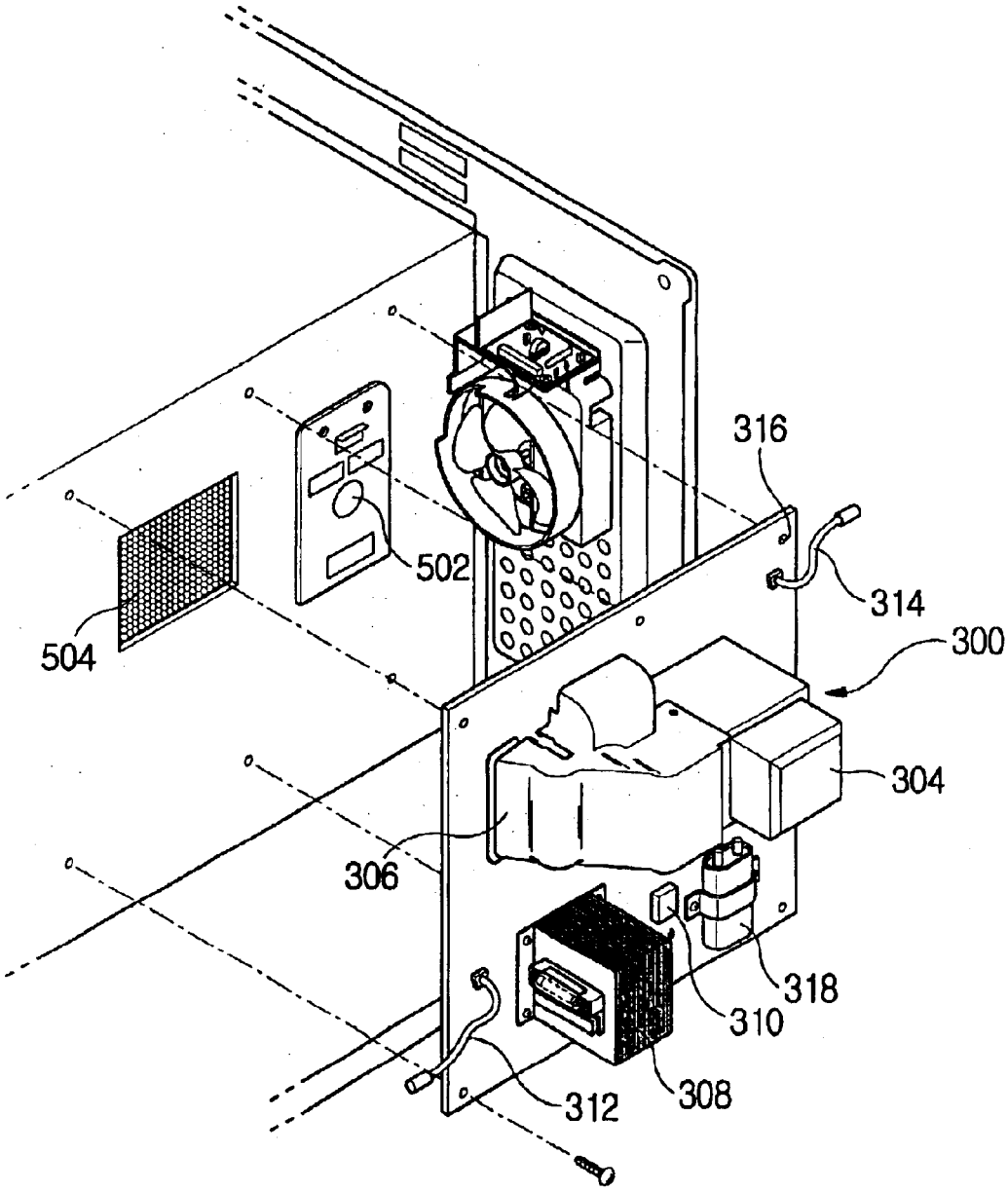
FIG. 5 is a partially exploded perspective view showing an attachment of the magnetron driving circuit board of FIG. 4 to a machine room.

FIG. 3B is a view showing a back of the magnetron driving circuit board 300. As depicted in FIG. 3B, an antenna 322 of the magnetron 304 protrudes from the back of the magnetron driving circuit board 300, and microwaves irradiate through the antenna 322. An air inlet 320 is formed in the circuit board 302 to supply air supplied through the air cover 306, as shown in FIG. 3A, to an interior of the cooking cavity. A waveguide (not shown) and an air inlet as shown in FIG. 5, must be formed in a partition wall 508, situated between the machine room 506, and the cooking cavity of the body of the microwave oven employing the magnetron driving circuit board 300 to correspond to positions of the antenna 322 and the air inlet 320. Accordingly, a layout and specifications of the above-described parts may be designed at a stage of developing a product.

Figure 4:
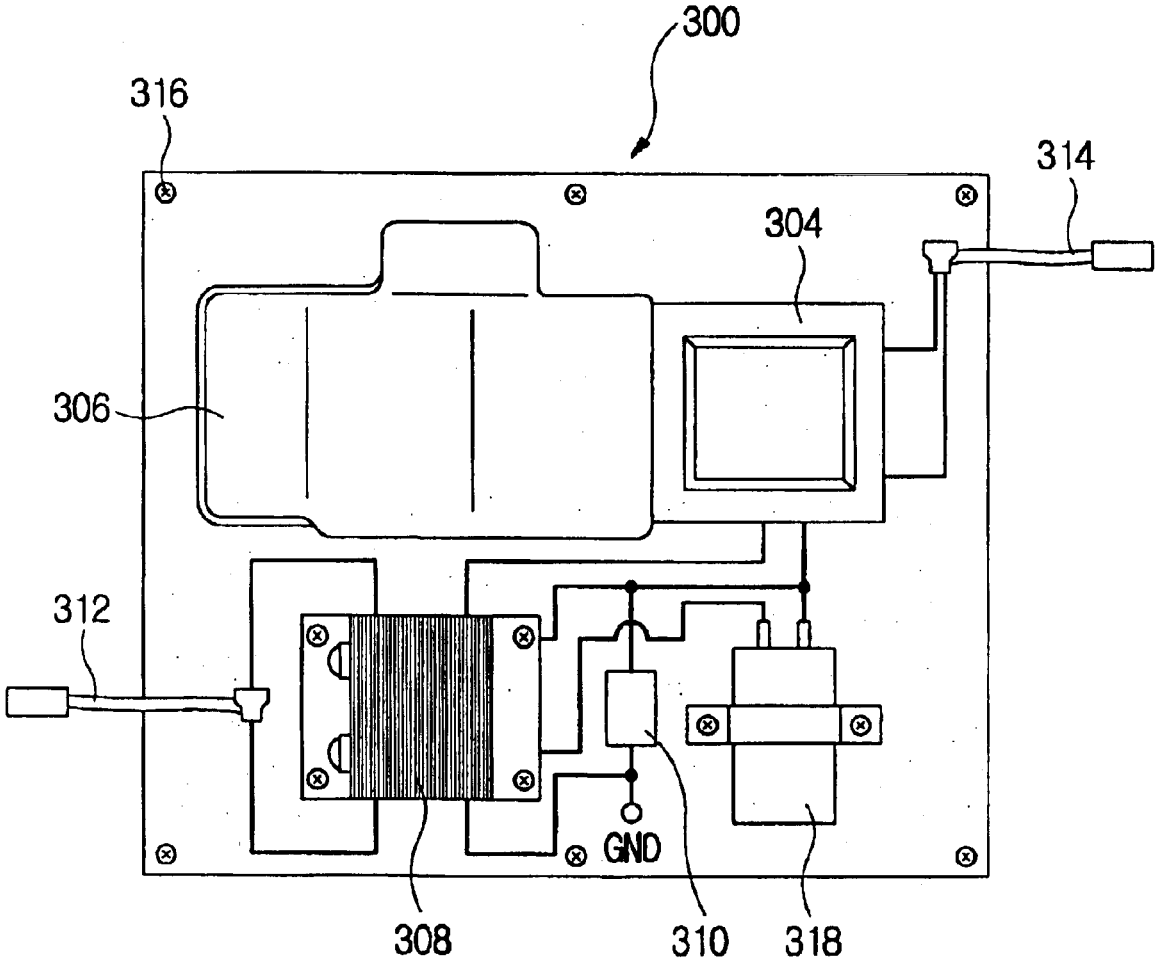
FIG. 4 is a diagram showing a wiring of the magnetron driving circuit board of FIG. 3A.

FIG. 4 is a diagram showing a wiring of the magnetron driving circuit board 300 of FIG. 3A. As depicted in FIG. 4, wiring is set up between the magnetron 304, the high voltage condenser 318, the high voltage diode 310 and the high voltage transformer 308, so that an alternating current AC voltage is converted into a direct current DC voltage by a rectification of the high voltage diode 310 and a smoothing by the high voltage condenser, the converted direct current DC voltage is boosted to a certain voltage and the boosted voltage is supplied to the magnetron 304. The wiring may be implemented by general coated copper wires or in a patterning manner that is generally used in printed circuit boards.

FIG. 5 is a partially exploded perspective view showing an attachment of the magnetron driving circuit board 300 to the machine room 506. As depicted in FIG. 5, when the magnetron driving circuit board 300 is fixedly mounted on the partition wall 508 of the machine room 506, the magnetron 304 and the air cover 306 are arranged to face an antenna receiving hole 502 and an air inlet 504, respectively. By mounting the magnetron driving circuit board 300 on the partition wall 508 of the machine room 506 using mounting members 510, the mounting of the magnetron 304 and the high voltage devices 308, 310 and 318 used to drive the magnetron 304 can be simply achieved.

Figure 6A:
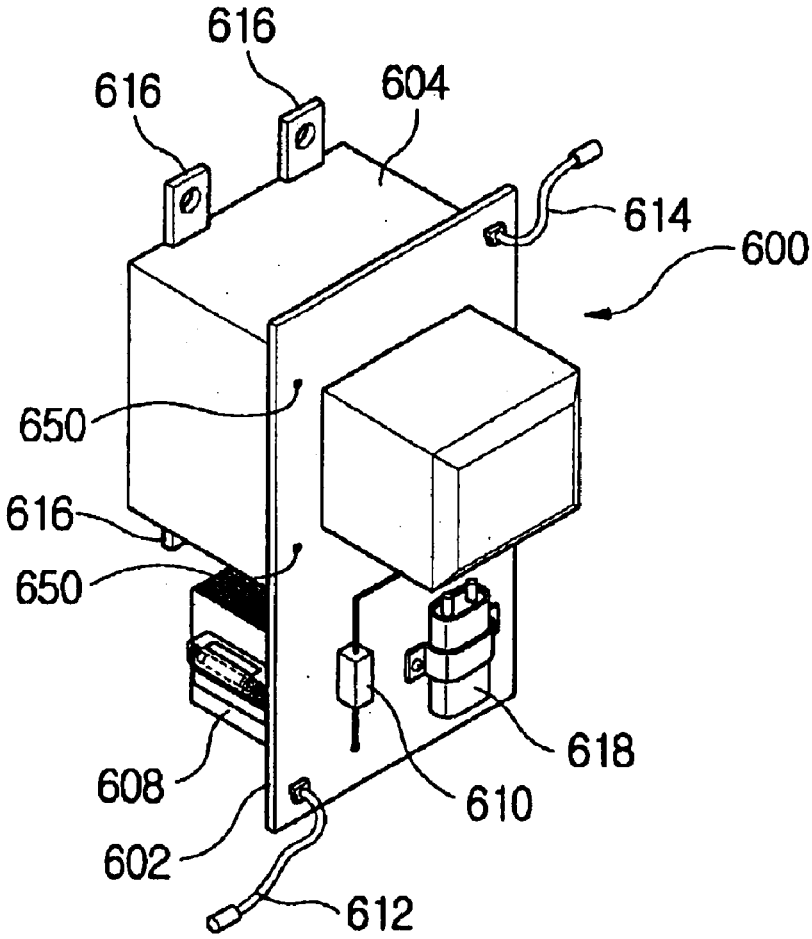
FIGS. 6A and 6B are views of a magnetron driving circuit board in accordance with a second embodiment of the present invention.
Figure 6B:
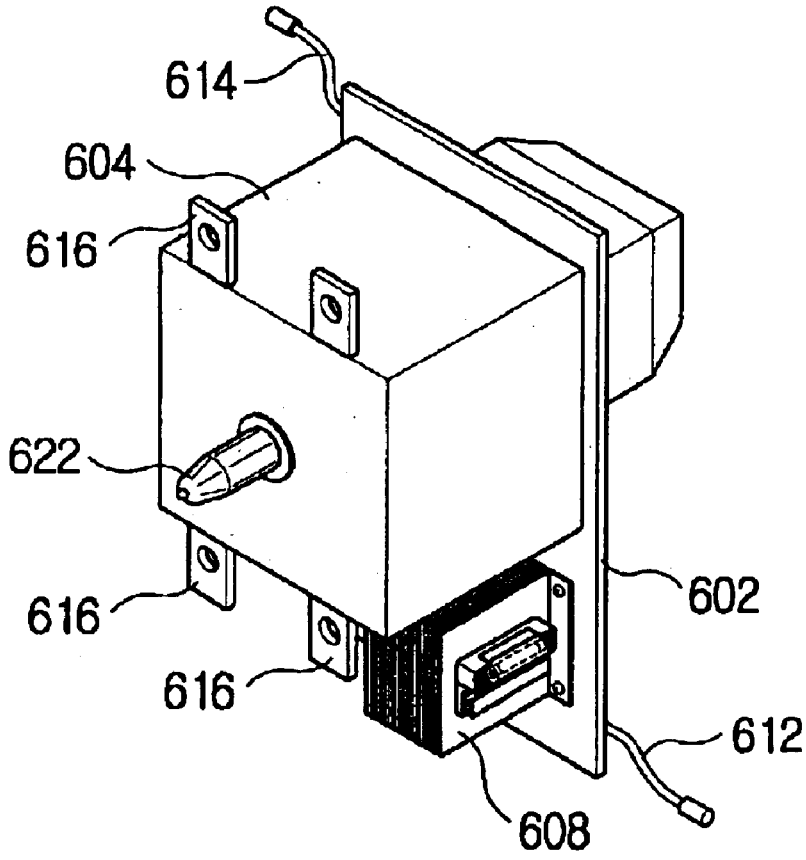

FIGS. 6A and 6B are views of a magnetron driving circuit board in accordance with a second embodiment of the present invention, which shows a case where an air cover does not exist and a magnetron 604 and high voltage devices, such as the high voltage transformer 608, the high voltage diode 610 and the high voltage condenser 618, are mounted on a board 602.

As depicted in FIGS. 6A and 6B, in a magnetron driving circuit board 600, the magnetron 604 is attached to the board 602 with a part of the magnetron 604 protruding from a front surface of the board 602. A plurality of mounting holes 650 is formed in the board 602. The magnetron 604 is secured to the board 602 by tightening mounting members into the mounting holes 650. A plurality of mounting holes 616 is formed on a back of the magnetron 604 so that the magnetron 604 is fixedly mounted on the partition wall separating the machine room and the cooking cavity of the oven body of the microwave oven by tightening mounting members into the plurality of mounting holes 616. The high voltage diode 610, a power cable 614, a control signal cable 612 and the high voltage condenser 618 are mounted on the front surface of the board 602, while the high voltage transformer 608 is mounted on a back surface of the board 602.

FIG. 6B is a view showing the back of the magnetron driving circuit board 600 of FIG. 6A. As depicted in FIG. 6B, the antenna 622 of the magnetron 604 protrudes from the back surface of the board 602, so microwaves irradiate from the antenna 622. Since the magnetron driving circuit board 600 is not provided with an air cover, a position of an installation of the magnetron driving circuit board 600 has to be determined in consideration of a position of a waveguide that is disposed between the machine room and the cooking cavity of the oven body of the microwave oven. Accordingly, a layout and specifications of the above-described parts may be designed at the stage of developing a product.

As is apparent from the above description, a microwave oven is provided in which a magnetron and other high voltage devices are mounted on a single circuit board to be packaged, so that an assembly of a machine room can be simplified, and utilization of the machine room can be increased or a size of an oven body can be reduced.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven having a magnetron that generates microwaves, a magnetron driving circuit that supplies high voltage power to the magnetron and a machine room that accommodates the magnetron and the magnetron driving circuit, comprising:

a single magnetron driving circuit board in which the magnetron and electronic devices of the magnetron driving circuit are mounted the thereon, wherein the magnetron driving circuit board is fixedly attached to the machine room by mounting members, wherein said electronic devices include a high voltage transformer, a high voltage diode and a high voltage condenser, and wherein the high voltage condenser and the high voltage diode are mounted on a first surface of the single magnetron driving circuit board and the high voltage transformer is mounted on a second surface of the single magnetron driving circuit board.

2. The microwave oven as set forth in claim 1, wherein said electronic devices are electrically connected to one another by coated copper wires.

3. The microwave oven as set forth in claim 1, wherein said electronic devices are electrically connected to one another in a patterning manner that is used in printed circuit boards.

4. The microwave oven as set forth in claim 1, further comprising:

an air cover mounted on the single magnetron driving circuit board to supply air to a cooking cavity of the microwave oven.

5. The microwave oven as set forth in claim 1, further comprising:

a control unit;

a power cable used to receive power from an outside source to the single magnetron driving circuit; and a control signal cable used to receive control signals from the control unit to the single magnetron driving circuit.

6. The microwave oven as set forth in claim 5, wherein the power cable and the control signal cable, respectively, are constructed in a form of a harness.

7. A magnetron driving circuit generating high voltage power used to drive a magnetron, comprising:

a single magnetron driving circuit board, the magnetron and electronic devices of the magnetron driving circuit mounted thereon, wherein the electronic devices include a high voltage transformer, a high voltage diode and a high voltage condenser, and wherein the high voltage condenser and the high voltage diode are mounted on a first surface of the single magnetron driving circuit board and said high voltage transformer is mounted on a second surface of the single magnetron driving circuit board.

8. The magnetron driving circuit as set forth in claim 7, wherein the electronic devices are electrically connected to one another by coated copper wires.

9. The magnetron driving circuit as set forth in claim 7, wherein the electronic devices are electrically connected to one another in a patterning manner that is used in printed circuit boards.

10. The magnetron driving circuit as set forth in claim 7, wherein at least one mounting hole is formed in the single magnetron driving circuit board and the single magnetron driving circuit board is fixedly attached to a machine room by tightening mounting members into the mounting hole.

11. The magnetron driving circuit as set forth in claim 7, further comprising:

a power cable used to receive power from an outside source; and a control signal cable used to receive control signals from a control unit.

12. The magnetron driving circuit as set forth in claim 11, wherein the power cable and control signal cable, respectively, are constructed in a form of a harness.

13. A microwave oven including a machine room disposed therein and a magnetron to generate microwaves, comprising:

a driving circuit to provide power to the magnetron, the driving circuit comprising:

high voltage components; and a single circuit board, the magnetron and the high voltage components being mounted on the single circuit board; and coupling members to couple the single circuit board to the machine room, wherein the high voltage components comprise a high voltage transformer, a high voltage diode, and a high voltage condenser, and wherein the high voltage condenser and the high voltage diode are mounted on one surface of the single circuit board and the high voltage transformer is mounted on an opposite surface of the single circuit board.

14. The microwave oven as set forth in claim 13, wherein the single circuit board comprises:

coated copper wires to electrically connect the high voltage components.

15. The microwave oven as set forth in claim 13, wherein the single circuit board comprises:

a printed circuit board pattem to electrically connect the high voltage components.

16. The microwave oven as set forth in claim 13, wherein the high voltage components are mounted on opposite sides of the single circuit board.

17. The microwave oven as set forth in claim 13, further comprising:

a control unit;

a power cable provided to receive power from an outside source; and a control signal cable to control the driving circuit by control signals from the control unit.

18. The microwave oven as set forth in claim 17, wherein the power cable and the control signal cable, respectively, are provided in a form of a harness.

19. The microwave oven as set forth in claim 13, wherein the coupling members comprise:

coupling holes formed along an edge of the single circuit board; and coupling units to be received in the coupling holes to couple the single circuit board to the machine room.

20. The microwave oven as set forth in claim 13, wherein:

the magnetron is mounted on one side of the single circuit board and comprises:

an antenna to radiate the microwave generated by the magnetron; and the single circuit board comprises:

an antenna receiving hole in the single circuit board such that the antenna of the magnetron protrudes therethrough from an opposite side of single circuit board.

21. A microwave oven including a machine room disposed therein and a magnetron to generate microwaves, comprising:

a driving circuit to provide power to the magnetron, the driving circuit comprising:

high voltage components; and a single circuit board, the magnetron and the high voltage components being mounted on the single circuit board;

coupling members to couple the single circuit board to the machine room;

a cooking cavity to cook food disposed in the microwave oven; and an air cover mounted on the single circuit board to supply air to the cooking cavity.

22. The microwave oven as set forth in claim 21, wherein:

the magnetron is mounted on one side of the single circuit board and comprises:

an antenna to radiate the microwave generated by the magnetron; and the single circuit board comprises:

an antenna receiving hole in the single circuit board such that the antenna of the magnetron protrudes therethrough from an opposite side of single circuit board.

23. The microwave oven as set forth in claim 22, further comprising:

a waveguide formed between the machine room and the cooking cavity; and an air inlet formed between the machine room and the cooking cavity wherein the single circuit board is positioned such that the antenna of the magnetron and the air cover of the single circuit board correspond to positions of the waveguide and the air inlet, respectively.

24. The microwave oven as set forth in claim 22, further comprising:

a waveguide formed between the machine room and the cooking cavity; and an air inlet formed between the machine room and the cooking cavity wherein the single circuit board is positioned according to positions of the waveguide and the air inlet.

25. A microwave oven having a magnetron that generates microwaves, a magnetron driving circuit to supplies power to the magnetron and a machine room to accommodate the magnetron and the magnetron driving circuit, comprising:

a constructional unit comprising:

electronic components of the magnetron driving circuit;

the magnetron; and a magnetron driving circuit board, the magnetron, the electronic components of the magnetron driving circuit being mounted thereon; and mounting members to couple the constructional unit to the machine rooms wherein the high voltage components comprise a high voltage transformer, a high voltage diode, and a high voltage condenser, and wherein the high voltage condenser and the high voltage diode are mounted on one surface of the single circuit board and the high voltage transformer is mounted on an opposite surface of the single circuit board.

* * * * *

UNITED STATES PATENT AND TRADEMARK OFFICE

CERTIFICATE OF CORRECTION

PATENT NO. : 6,906,298 B2
DATED : June 14, 2005
INVENTOR(S) : Dae-Sung Han et al.

It is certified that error appears in the above-identified patent and that said Letters Patent is hereby corrected as shown below:

Column 4,
Line 62, change “mounted the” to -- mounted --.

Column 6,
Line 23, change “pattem” to -- pattern --.

Column 8,
Line 16, change “rooms” to -- room --.

Signed and Sealed this

Fourteenth Day of March, 2006

JON W. DUDAS
*Director of the United States Patent and Trademark Office*